US006655866B1

(12) United States Patent
Morad et al.

(10) Patent No.: US 6,655,866 B1
(45) Date of Patent: Dec. 2, 2003

(54) MOP WITH PUMP ACTION MECHANISM FOR DISPENSING LIQUID THROUGH AN ELEVATED SPRAY NOZZLE

(75) Inventors: Fred I. Morad, Toluca Lake, CA (US); James G. Horian, Newport Beach, CA (US)

(73) Assignees: Worldwide Integrated Resources, Inc., Commerce, CA (US); part interest; Metro Bay Products, Inc., Costa Mesa, CA (US); part interest ( * ) Notice: Subject to any disclaimer, the term of this patent is extended or adjusted under 35 U.S.C. 154(b) by 0 days.

(21) Appl. No.: 10/194,837

(22) Filed: Jul. 12, 2002

(51) Int. Cl.[7] ..... A47L 13/26; A46B 11/02

(52) U.S. Cl. ..... 401/139; 401/138; 401/137; 401/140; 401/188 R; 401/272

(58) Field of Search ..... 401/139, 138, 401/137, 140, 268, 270, 272, 273, 276, 278, 279, 187, 188 R

(56) References Cited

U.S. PATENT DOCUMENTS

| | | | | |
|---|---|---|---|---|
| 2,187,671 A | | 1/1940 | Suddarth | |
| 2,893,607 A | * | 7/1959 | Vosbikian et al. | 222/191 |
| 3,092,293 A | | 6/1963 | Helm | |
| 3,262,670 A | | 7/1966 | Marlett | |
| 4,037,817 A | | 7/1977 | Chernak | |
| 4,044,989 A | | 8/1977 | Basel | |
| 4,119,386 A | | 10/1978 | Cushing | |
| 4,863,299 A | | 9/1989 | Osberghaus | |
| 5,232,298 A | | 8/1993 | Mitsunari | |
| D364,948 S | | 12/1995 | Hunt | |
| D372,570 S | | 8/1996 | Dokos | |
| D401,703 S | | 11/1998 | Beechuk | |
| 5,888,006 A | | 3/1999 | Ping | |
| 5,988,920 A | | 11/1999 | Kunkler | |
| 6,045,622 A | | 4/2000 | Holt | |
| 6,048,123 A | | 4/2000 | Holt | |
| D428,226 S | | 7/2000 | Kunkler | |
| 6,101,661 A | | 8/2000 | Policicchio | |
| 6,179,503 B1 | | 1/2001 | Taghavi-Khanghah | |
| 6,217,244 B1 | | 4/2001 | Chen | |
| 6,227,744 B1 | | 5/2001 | Fodrocy et al. | |
| 6,315,481 B1 | * | 11/2001 | Gavorski et al. | 401/150 |

FOREIGN PATENT DOCUMENTS

| | | | | |
|---|---|---|---|---|
| DE | 4204858 A | * | 8/1992 | A46B/11/02 |
| WO | PCT/FR86/00087 | | 9/1986 | |

* cited by examiner

*Primary Examiner*—David J. Walczak
(74) *Attorney, Agent, or Firm*—Thomas I. Rozsa; Tony D. Chen

(57) ABSTRACT

A mop having a container housing cleaning liquid attached to the mop handle and a new and improved actuation mechanism which employs the use of atmosphere and pneumatics to cause power transmission from the grip area of the mop handle to the fluid actuation area. A mechanism for transmitting discharge power generated by a pump action motion of the handle, similar to loading a shotgun, through the interior of the handle to an actuation diaphragm which causes a valve closing mechanism to open by a vacuum generated from the pump action mechanism, to permit the fluid to be discharged from its container through a nozzle located at the lower portion of the diaphragm while at the same time causing an equal amount of air to fill the fluid container to thereby assure a smooth and even spray of liquid through the nozzle.

53 Claims, 5 Drawing Sheets

FIG. 3
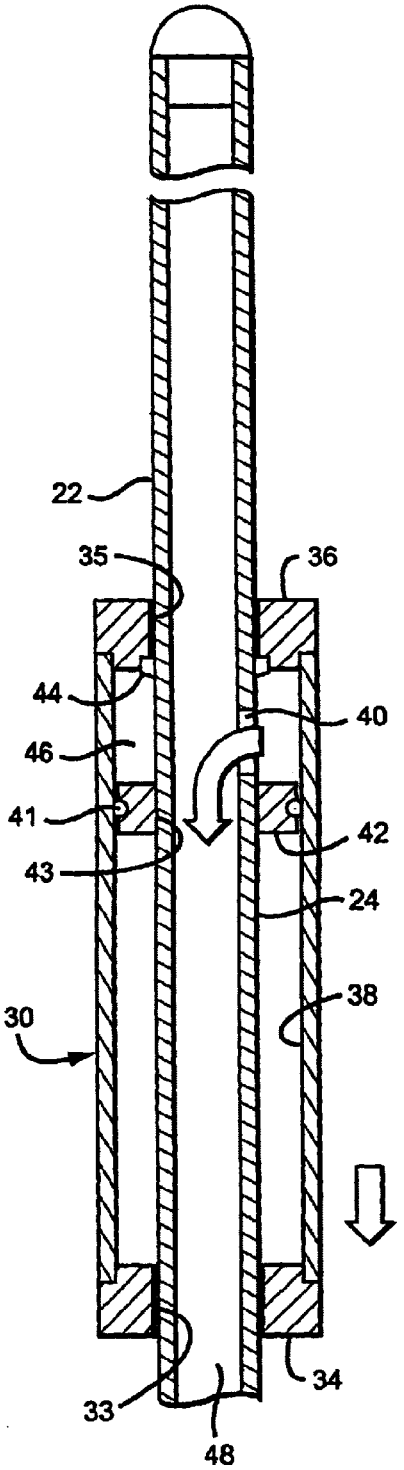
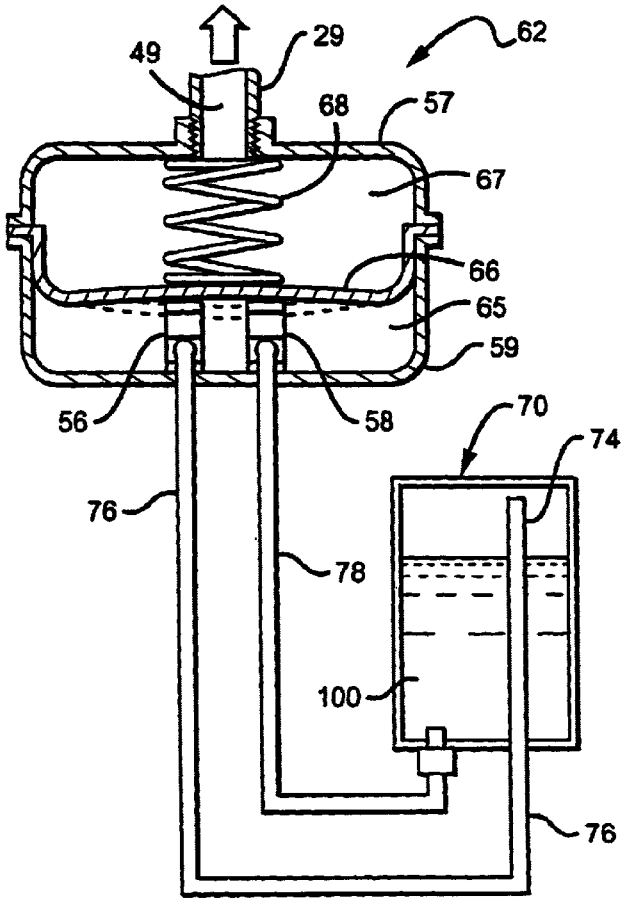
FIG. 5
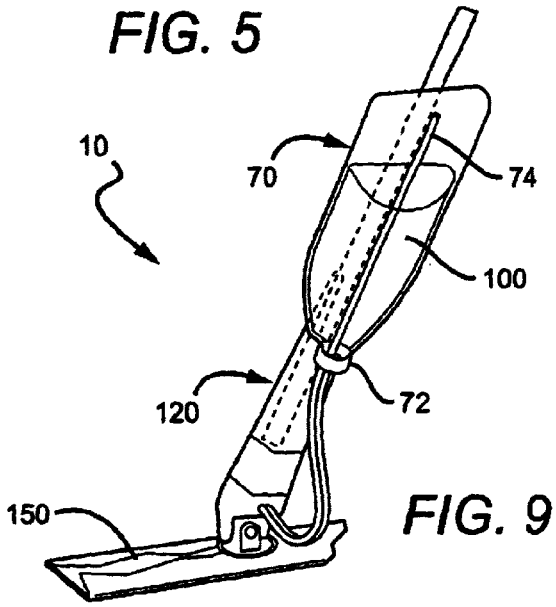
FIG. 9

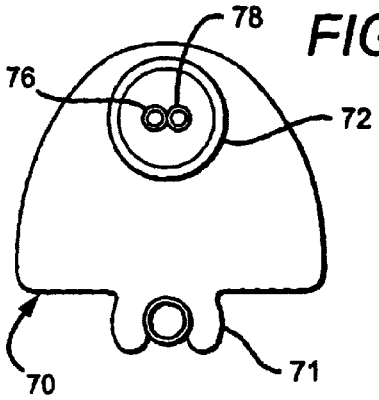
FIG. 11
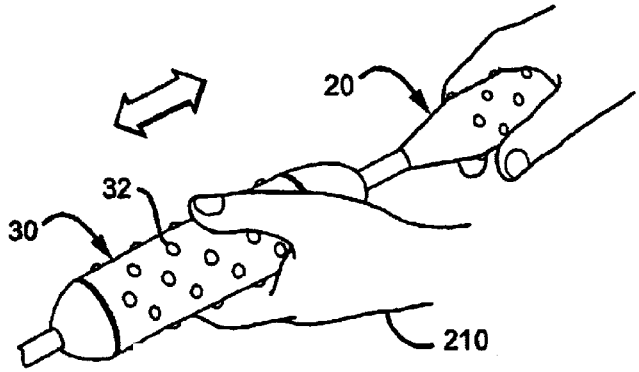
FIG. 12
FIG. 13
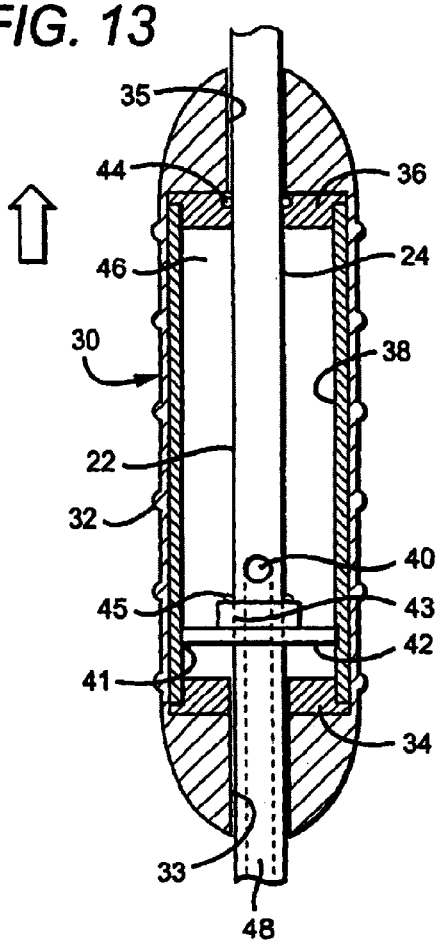
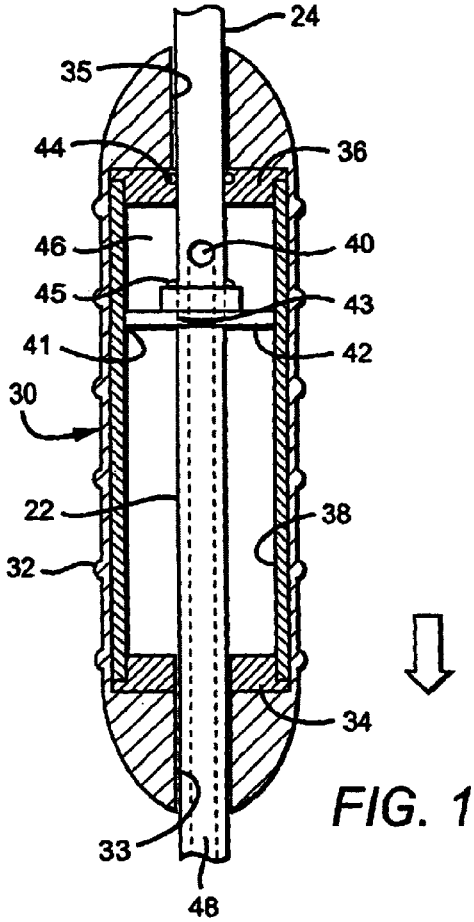
FIG. 14

MOP WITH PUMP ACTION MECHANISM FOR DISPENSING LIQUID THROUGH AN ELEVATED SPRAY NOZZLE

BACKGROUND OF THE INVENTION

1. Field of the Invention

The present invention relates to the field of cleaning implements and more particularly, to mops. The field of the present invention more particularly relates to the field of mops having a self contained reservoir of cleaning liquid and means for causing the liquid to be dispensed from the reservoir in measured amounts so that the cleaning liquid is sprayed ahead of the mop to facilitate cleaning.

2. Description of the Prior Art

In general, mops which have a reservoir of cleaning liquid and a means to cause a liquid to be dispensed from the reservoir have been developed. The following patents illustrate the current state of the art in this area:

1. U.S. Pat. No. 4,119,386 issued to Cushing on Oct. 10, 1978 for "Mop Assembly To Distribute Selected Liquids On Floor Areas, To Be Waxed, Cleaned, And/Or Stripped" (hereafter the "Cushing Patent");
2. U.S. Pat. No. 4,863,299 issued to Osberghaus on Sep. 5, 1989 for "Applicator For Liquid Floor Treatment Preparations" (hereafter the "Osberghaus Patent");
3. U.S. Pat. No. Des. 364,948 issued to Hunt on Dec. 5, 1995 for "Mop Handle With Reservoir" (hereafter the "Hunt Patent");
4. U.S. Pat. No. Des. 372,570 issued to Dokos on Aug. 6, 1996 for "Gravitationally-Fed Cleaning Mop For Floors, And Walls" (hereafter the "Dokos Patent");
5. U.S. Pat. No. Des. 401,703 issued to Beechuk on Nov. 24, 1998 for "Cleaning Implement" (hereafter the "Beechuk Patent");
6. U.S. Pat. No. 5,888,006 issued to Ping on Mar. 30, 1999 for "Cleaning Implement Having A Sprayer Nozzle Attached To A Cleaning Head Member" (hereafter the "Ping Patent");
7. U.S. Pat. No. 5,988,920 issued to Kunkler on Nov. 23, 1999 for "Cleaning Implement Having A Protected Pathway For A Fluid Transfer Tube" (hereafter the "'920 Kunkler Patent");
8. U.S. Pat. No. 6,045,622 issued to Holt on Apr. 4, 2000 for "Method Of Cleaning A Hard Surface Using Low Levels Of Cleaning Solution" (hereafter the "'622 Holt Patent");
9. U.S. Pat. No. 6,048,123 issued to Holt on Apr. 11, 2000 for "Cleaning Implement Having High Absorbent Capacity" (hereafter the"'123 Holt Patent");
10. U.S. Pat. No. Des. 428,226 issued to Kunkler on Jul. 11, 2000 for "Cleaning Implement" (hereafter the"'226 Kunkler Patent");
11. U.S. Pat. No. 6,101,661 issued to Policicchio on Aug. 15, 2000 for "Cleaning Implement Comprising A Removable Cleaning Pad Having Multiple Cleaning Surfaces" (hereafter the "Policicchio Patent");
12. U.S. Pat. No. 6,217,244 B1 issued to Chen on Apr. 17, 2002 for "Sponge Mop With A Cleaning Tank Attached Thereto" (hereafter the "Chen Patent");
13. U.S. Pat. No. 2,187,671 issued to Suddarth on Jan. 16, 1940 for "Applicating Device " (hereafter the "Suddarth Patent");
14. U.S. Pat. No. 3,092,293 issued to Helm on Jun. 4, 1963 for "Shampoo Attachment For Floor Polisher" (hereafter the "Helm Patent");

15. U.S. Pat. No. 3,262,670 issued to Marlett on Jul. 26, 1966 for "Spring Actuated Pinchcock" (hereafter the "Marlett Patent");
16. U.S. Pat. No. 4,037,817 issued to Chernak on Jul. 26, 1977 for "Pinch Tube Valve" (hereafter the "Chernak Patent");
17. U.S. Pat. No. 4,044,989 issued to Basel on Aug. 30, 1977 for "Pinch Tube Valve" (hereafter the "Basel Patent");
18. U.S. Pat. No. 5,232,298 issued to Mitsunari on Aug. 3, 1993 for "Applicator For Applying A Liquid Medium With Valve For Tube Nozzles" (hereafter the "Mitsunari Patent");
19. U.S. Pat. No. 6,179,503 B1 issued to Taghavi-Khanghah on Jan. 30, 2001 for "BRUSH" (hereafter the "Taghavi-Khanghah Patent");
20. U.S. Pat. No. 6,227,744 B1 issued to Fodrocy on May 8, 2001 for "Liquid Dispensing Apparatus For Cleaning Implements" (hereafter the "Fodrocy Patent");
21. PCT Application No. PCT/FR86/00087 filed on Sep. 25, 1986 for "Apparatus Combining Chemical And mechanical Action, To Remove Residues Adhering To The Soil; Also Use Of the Apparatus For Sweeping And Spreading Liquid Products" (hereafter the "'00087 PCT Application");

The Cushing Patent discloses a mop assembly provided to uniformly and controllably apply and distribute liquids to the surfaces of exposed floors. A tank contains the liquid and a control rod inside the sleeve passing through the tank permits operation of a control valve on a discharge port at the bottom of the tank. The liquid is fed through tubing connected to the discharge port to dispense liquid into a mopping pad. Another head consists of an elongated plate having an attached fibrous pad and a liquid distribution header which has a multiplicity of holes along one edge. A resilient connection secured between the head and the handle biases the head to fully contact the floor.

The Osberghaus Patent discloses a container for liquid floor treatment preparations adapted to be mounted on a handle wherein the container includes a return flow cutoff funnel with an inlet, and a lower outlet tube with an exit port coupled to one end of a flexible hose that is selectively kinked to prevent fluid flow from the container to the floor, or un-kinked to obtain such fluid flow. The Osberghaus Patent also discloses a liquid floor treatment applicator having a tubing for supplying a liquid treatment which is maintained in a normally kinked position, whereby a sliding sleeve located on the handle of the applicator allows the tubing to be unkinked for dispensing the liquid treatment.

The Hunt Patent is a design patent for mop handle with a reservoir and protects the shape of the mop handle as opposed to its functionality.

The Dokos Patent is also a design patent which protects the shape of the structure. The device discloses a mop with a reservoir with tubes that extend into the mop so that it can mop the floor.

The Beechuk Patent discloses the concept of a mop having a reservoir for the purpose of dispensing fluid to the mop head and it has a trigger mechanism to assist in the dispensing of fluid from the reservoir.

The Ping Patent discloses a cleaning implement having a liquid delivery system including a handle with a first and second end, a cleaning head member attached to the handle at the first end, and a sprayer nozzle preferably attached to the cleaning head member, independent of the handle, for providing increased directional control of the sprayer nozzle. In particular, the sprayer nozzle is attached to the cleaning head member, thereby enabling rotational movement of the handle to provide increased directional control of the sprayer nozzle.

The '920 Kunkler Patent discloses a cleaning implement having a protective pathway for the fluid transfer tube. In this case, the fluid transfer tube is positioned within a universal joint to prevent the fluid transfer tube from becoming entangled with the universal joint so that as fluid is dispensed from the reservoir, it can smoothly be transmitted through the mop to the floor.

The '622 Holt Patent discloses the concept of dispensing fluid to a mop head so that it can be dispensed in a controlled manner having timed release with the fluid. The novel feature of this patent concerns the nature of the cleaning pad.

The '123 Holt Patent is similar in concept to the '622 Holt Patent and has the same areas of novelty with respect to a novel cleaning pad.

The '226 Kunkler Patent protects the shape and ornamental design of the mop disclosed therein which has a fluid dispensing reservoir for fluid dispensed into the mop head for cleaning.

The Policicchio Patent also discloses an implement for cleaning a surface wherein the key feature of novelty is the nature of the mop pad.

The Chen Patent discloses a sponge mop with a cleaning tank and in this case, the nature of the mop is a roller sponge mop as opposed to a flat sponge mop.

The Fodrocy Patent discloses the concept of having liquid inside the handle itself and extending out the handle through a nozzle 98 which is in the handle and is above the location where the mop is attached to the handle. The unique feature of this invention employs the concept of having liquid contained within the handle itself and having a valve mechanism in the upper portion of the handle which, when the valve mechanism is pressed, allows air to be inserted into the handle in a sufficient amount so that the quantity of air being inserted is equal to the amount of liquid being discharged through the nozzle 98 so that there is smooth flow of liquid.

The Suddarth Patent discloses mop having a fluid reservoir attached to the mop with a vent tube to permit air to displace fluid as a it exits the reservoir. In this case, the fluid conduit goes directly into the mop pad where it is directly spread onto the floor. The patent also discloses the concept of being able to shut off the flow of liquid by a kinking mechanism wherein the eye is caused to pinch the conduit 11 when the rod 17 is moved downwardly as illustrated in FIG. 2.

The Taghavi-Khanghah Patent discloses a brush having a diaphragm controlled valve which is influenced by atmospheric pressure. The device relates to a toothbrush.

The Mitsunari Patent 1993 discloses an applicator for applying a liquid such as floor wax. The key feature of this invention is that the liquid medium feeding mechanism comprises a trigger lever disposed at the upper end part of the grip handle to be depressed with an operator's finger and a moveable pressure plate operatively connected to the trigger lever via connecting means to open or close the respective tube nozzles in the clamped state in cooperation with a stationary pressure plate. When the trigger lever is released from the depressed state, the tube nozzles are closed in the clamped state. Also, the liquid goes directly into the mop structure and isn't sprayed out above the location of the mop structure.

The Chernak Patent discloses a pinch valve for deformable tubes when used in conjunction with a mop.

The Basel Patent also discloses a pinch valve when used for the purposes of stopping fluid flow of liquid cleaning fluid in a mop.

The Marlett Patent also discloses a pinch actuated valve mechanism.

The Helm Patent discloses a liquid applicating device. It specifically discloses a shampoo attachment for a floor polisher.

The Patent WO 86/05376 discloses a liquid spreading device having a liquid container mounted to a handle and whereby the flow of the liquid is controlled by pinching a flexible tube.

While there have been many recent developments in this area, there is still a significant need for an improved mop having a simpler and more cost efficient actuation mechanism to cause the liquid to be dispensed from the container and at a location above the mop and not imbedded into the mop area itself.

SUMMARY OF THE INVENTION

The present invention is a mop having a container housing cleaning liquid attached to the mop handle and a new and improved actuation mechanism which employs the use of atmosphere and pneumatics to cause power transmission from the grip area of the mop handle to the fluid actuation area.

The present invention also incorporates a means for transmitting discharge power generated by a pump action motion of the handle, similar to loading a shotgun, through the interior of the handle to an actuation diaphragm which causes valve closing means to open by a vacuum generated from the pump action mechanism, to permit the fluid to be discharged from its container through a nozzle located at the lower portion of the diaphragm while at the same time causing an equal amount of air to fill the fluid container to thereby assure a smooth and even spray of liquid through the nozzle.

It has been discovered, according to the present invention, that if the handle of a mop is designed with an opening in its exterior circumferential wall which extends into an interior air passage which runs the remaining length of the handle and a grip member which is slidably affixed to the handle forms an airtight chamber surrounding the handle at the location of the opening, then the grip member can be used to generate a suction force within the handle to be used to overcome a spring force or other positive force valve closing means which retains valves in their normally closed position.

It has also been discovered, according to the present invention, that if a source of cleaning fluid is dispensed through a fluid dispensing line which is retained normally shut by a valve having a positive force exerted on it, the valve can be opened by the suction created by the slidable grip member generating a sufficient force to overcome the force which maintains the valve normally closed.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 3 is a schematic representational view of the present invention illustrating a cross sectional view as illustrated in FIG. 2, with the pump action completed at one end of the vacuum cycle and the reverse action required to close the fluid valves;

FIG. 5 is a cross sectional schematic representational view taken along Line 5—5 of FIG. 4 and illustrating the fluid flow from the fluid reservoir;

FIG. 9 is a rear perspective cutaway view of the lower portion of the present invention mop assembly;

FIG. 11 is a cross sectional view of the fluid retaining reservoir and the cap with fluid flow tubes;

FIG. 12 is an enlarged perspective view of the handle area of the present invention, illustrating the pumping action by a user;

FIG. 13 is a side cutaway view of the actual pump action portion of the handle, which was schematically illustrated in FIG. 2; and FIG. 14 is a side cutaway view of the pump action portion of the handle, which was schematically illustrated in FIG. 3.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The fundamental principle of the present invention which differentiates it from all of the prior art mop assemblies discussed in the Description of the Prior Art section is the use of atmosphere and pneumatics to cause power transmission from the grip area of the mop handle to the fluid valve actuation area. This enables the fluid nozzle through which cleaning fluid is disbursed to sit at a location well above the mop pad, sponge mop, or other cleaning implement and also above the intersection of the handle and the mop cleaning implement, to thereby provide a more effective spray of the cleaning liquid to facilitate mopping and also provide a less expensive to produce and more reliable fluid actuation and disbursing apparatus than the embodiments disclosed in the prior art.

FIGS. 1 through 5 disclose representational views which illustrate how the present invention works and FIGS. 6 through 14 illustrate the actual embodiments of the present invention. For consistency, the parts will be numbered the same in FIGS. 1 through 5 and in FIGS. 6 through 14.

Figure 1:
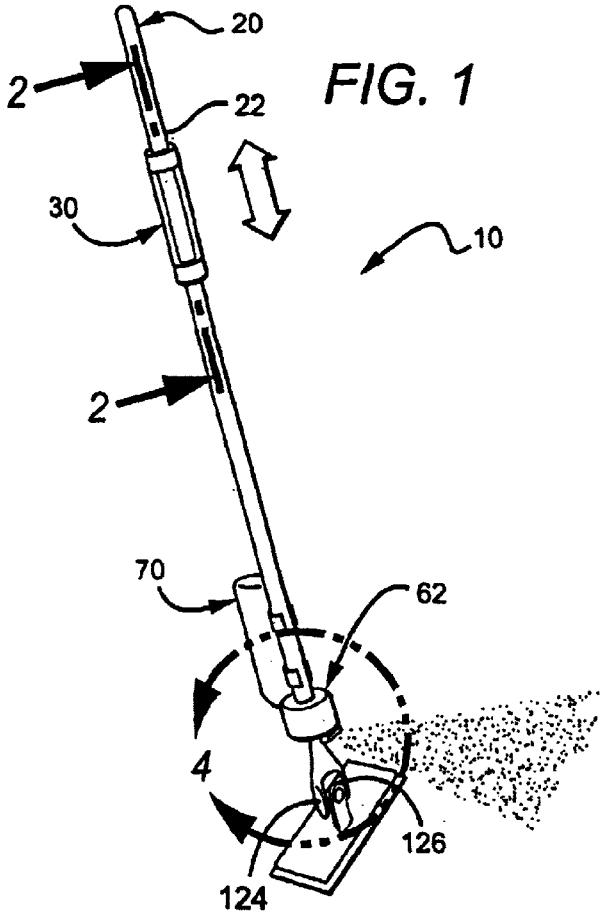
FIG. 1 is a schematic representational view of the present invention mop with pump action mechanism disclosing key features of the invention.
Figure 6:
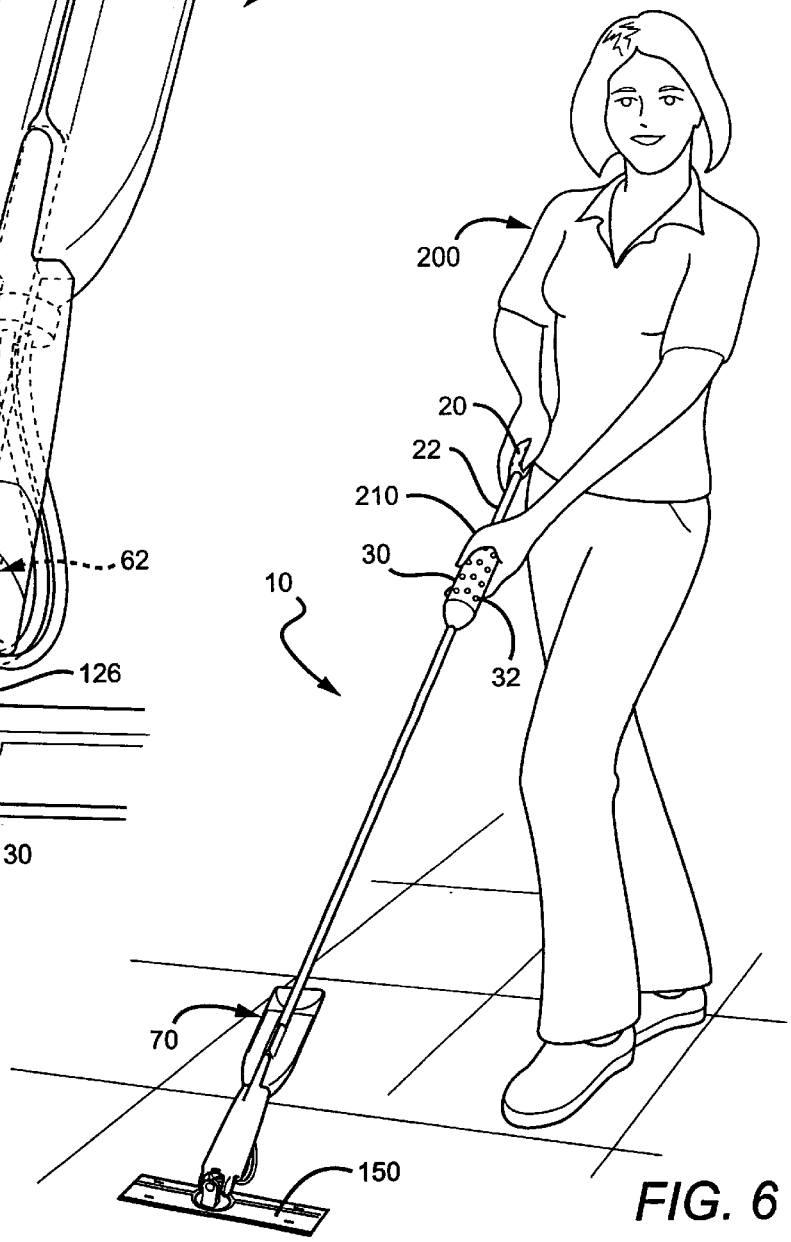
FIG. 6 is a perspective view of the present invention mop being used by a woman activating the pump action mechanism to cause cleaning liquid to be dispensed from its reservoir.

Referring to FIG. 1 and FIG. 6, the entire mop assembly is shown at 10. Referring to FIGS. 1 through 6 and 12 through 14, the grip area of the mop is designated at 20. At the grip area of the mop handle 20 is a grip tube 30 which the consumer 200 pulls upwards and pushes downwardly similar to reloading a shotgun. The grip tube 30 has an outer textured casing 32 which facilitates gripping the grip tube 30 by the consumer's hand 210 and a cylindrical interior wall 38. The grip tube 30 is slidably affixed to the upper section 22 of the mop handle 20. Adjacent opposite interior ends of the grip tube 30 is a top plug 36 and a bottom plug 34. Top plug 36 has an interior opening 35 surrounding outer wall 24 of handle section 22 and bottom plug 34 has an interior opening 33 surrounding outer wall 24 of handle section 22. Top and bottom plugs 36 and 34 cap either end of the interior wall 38 of grip tube 30. Adjacent bottom plug 34 and spaced apart therefrom is a fixed piston 42 having an interior opening 43 surrounding outer wall 24 of handle section 22. Fixed piston 42 is affixed to outer wall 24 of handle 20 by means such as rivets. Fixed piston 42 also has two seals, an exterior seal 41 and an interior seal 45 adjacent handle section 22. Top plug 36 has a seal 44. Therefore, the chamber 46 formed by interior grip member wall 38, top plug 36 and its seal 44, and piston 42 and its seals 41 and 45 form an airtight chamber. Within airtight chamber 46 and formed within the wall 24 of handle 20 is an air hole 40. Handle section 22 has an interior passage 48 connected to opening 40.

Figure 2:
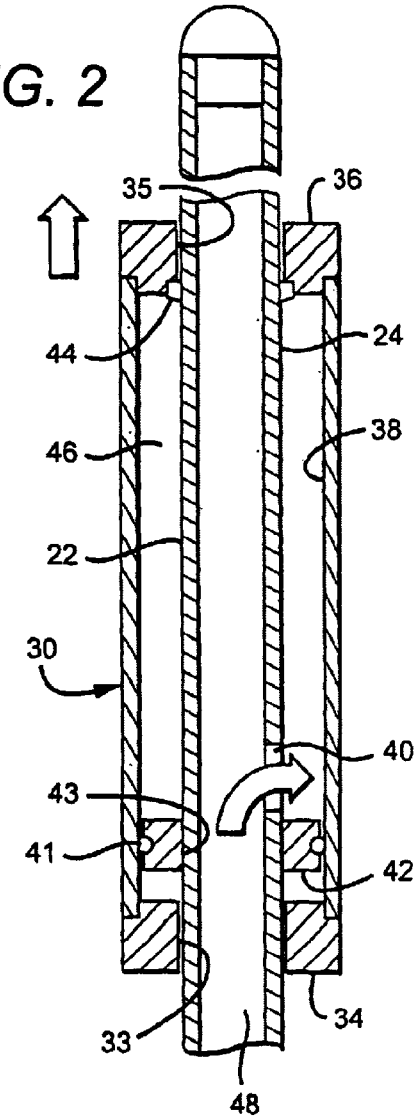
FIG. 2 is a schematic representational view of the present invention illustrating a cross sectional view taken along Line 2—2 of FIG. 1, illustrating the initial activation of the hand pumping action.

In operation, the starting position is illustrated in FIGS. 3 and 14. The grip member 30 is at its lowermost position on handle 20 with the opening 40 adjacent upper plug 36 and the volume of air in chamber 46 having the smallest volume. As the grip member 30 is pulled upwardly on handle 20, the volume of chamber 46 increases to its maximum volume as illustrated in FIGS. 2 and 13. At the end of the initial cycle which is illustrated in FIGS. 2 and 13, the grip member 30 has been moved upwardly on handle 20 so that opening 40 is now closer to lower plug 34 than to upper plug 36. Since the volume of air chamber 46 has been increased, the air is drawn out of air passage 48 through opening 40 to thereby create a suction force within air passage 48. To remove the suction force, the grip member 30 is moved downwardly on handle 20 so that fixed piston 42 and opening 40 are now closer to upper plug 36, thereby decreasing the volume of air in chamber 46 and forcing air back into air passage 48 through opening 40 to return the air in air passage 48 to atmospheric pressure.

The fluid reservoir, fluid dispensing nozzle, and fluid control assembly located adjacent the lower portion of mop 10 are illustrated in FIGS. 4, 5 and 7 through 11. A fluid reservoir 70 containing cleaning fluid 100 therein is attached to a section of the mop handle 22A by a clip member 71. It will be appreciated that handle 20 can have several sections such as 22, 22A and 26 are mated together by means such as threaded engagement, with air passage 48 continuously running through all connected sections. By way of example, the cleaning fluid reservoir 70 can be a bottle of cleaning liquid. The bottle can be made of hard material or more flexible or collapsible material. The reservoir 70 has a closing means 72 which by way of example can be a bottle cap 72. The cap surrounds a horizontal plate 69. Formed with horizontal plate 69 are two rod means 73 and 75. First rod means 73 is connected at one end to an air supply rod 74 which extends into fluid reservoir 70 and terminates adjacent the top of the reservoir 70 above the level of cleaning fluid 100 but spaced apart from the top to leave an air gap. First rod means 73 is connected at its opposite end to an air supply line 76. Second rod 75 is in fluid communication with the supply of fluid 100 within the reservoir and is connected at its opposite end to a fluid discharge line 78.

The preferred embodiment is to have the fluid reservoir made of non-flexible or non-collapsible material in which case the air supply rod 74 is necessary. If the fluid reservoir is made of flexible or collapsible material, the air supply can be eliminated.

Figure 4:
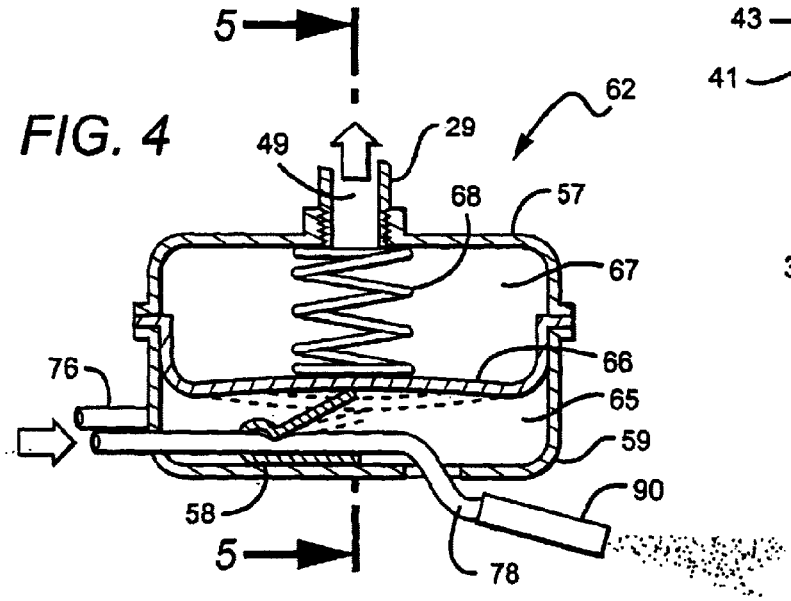
FIG. 4 is a cross sectional schematic representational view of the diaphragm assembly of the present invention including the fluid discharge nozzle and the fluid valve closing means.
Figure 8:
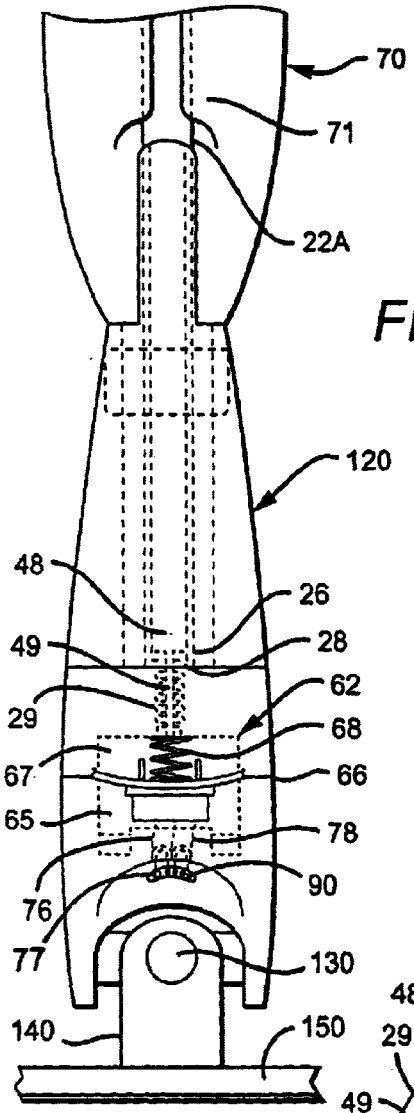
FIG. 8 is a front elevational cutaway view of the lower portion of the present invention mop assembly.

The handle 20 is formed of a multiplicity of engageable sections 22, 22A and 26 which are interconnected by means such as a threaded engagement so that interior air passage 48 runs the entire interior length of the handle from its lowermost position up to the opening 40. The lowermost portion 26 of handle 20 terminates in a valve actuation diaphragm 62. The valve actuation diaphragm is made of two sections which are joined together, upper section 57 and lower section 59. The upper and lower sections are made of fairly rigid material such as rigid plastic. The valve actuation diaphragm 62 is divided into two chambers by a flexible valve actuation seam 66 located between upper section 57 and lower section 59 which divides the valve actuation diaphragm into an upper chamber 67 located in upper section 57 and a lower chamber 65 located in lower section 59. While the positive force means is illustrated as a coil spring, it will be appreciated that any positive force means such as a compression sponge or other device which exerts a positive downward force is within the spirit and scope of the present invention. The upper chamber 67 houses a valve actuation force means 68 which by way of example is a coil spring which exerts a downward positive force on the valve actuation seam 66. Lower chamber 65 houses valve shutoff means 56 and 58. Valve shutoff means 56 is engaged with air supply line 76 and valve shutoff means 58 is engaged with fluid discharge line 78. By way of example, valve shutoff means 56 is a pinch valve and valve shutoff means 58 is also a pinch valve. At its end 77 opposite from the rod means 73, air supply line 76 is open to the atmosphere. At its end 79 opposite from rod 75, fluid discharge line 78 terminates in a spray nozzle 90. As illustrated in FIG. 8, nozzle 90 has four openings. One opening is the end of air supply line 76 which opens to the atmosphere. The other three openings are the fluid discharge openings to which fluid discharge line 78 is connected. Referring to FIGS. 4 and 8, lowermost end 26 of handle 20 terminates in an end cap 28 which includes a threaded male member 29 having an air passage 49 in fluid communication with air passage 48. The air passage 49 of threaded male member 29 is in fluid communication with the upper chamber 67 of diaphragm 62. By way of example, threaded male member 29 can be threadedly engaged to the upper surface of diaphragm 62 as illustrated in FIG. 4.

Figure 7:
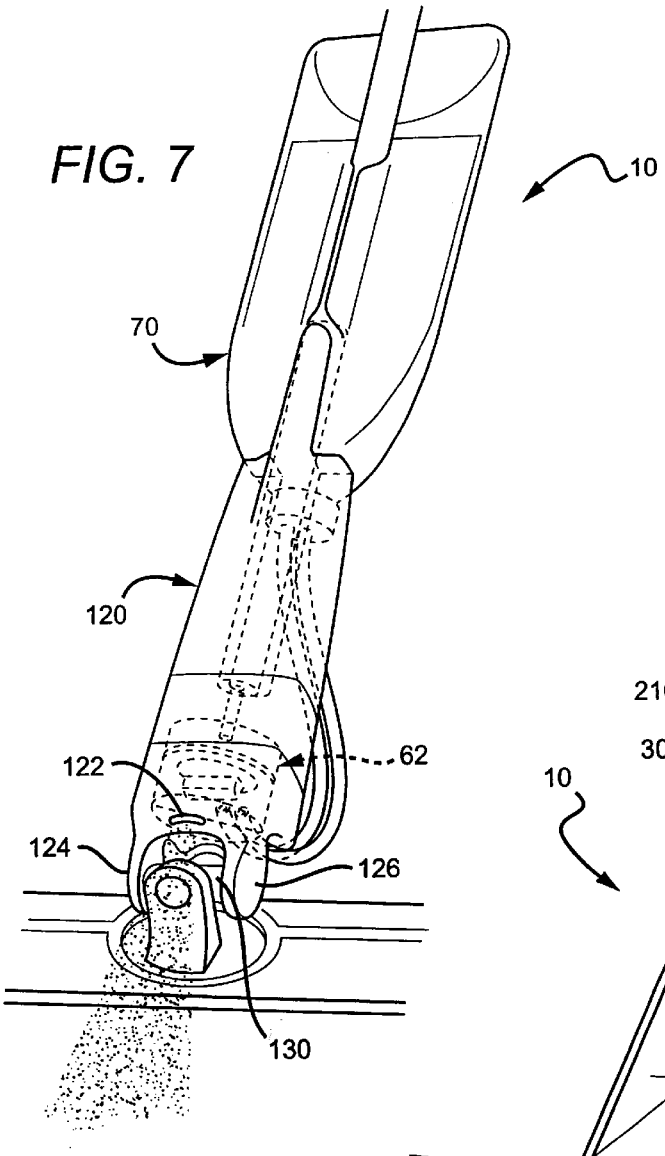
FIG. 7 is a front perspective cutaway view of the lower portion of the present invention mop assembly.
Figure 10:
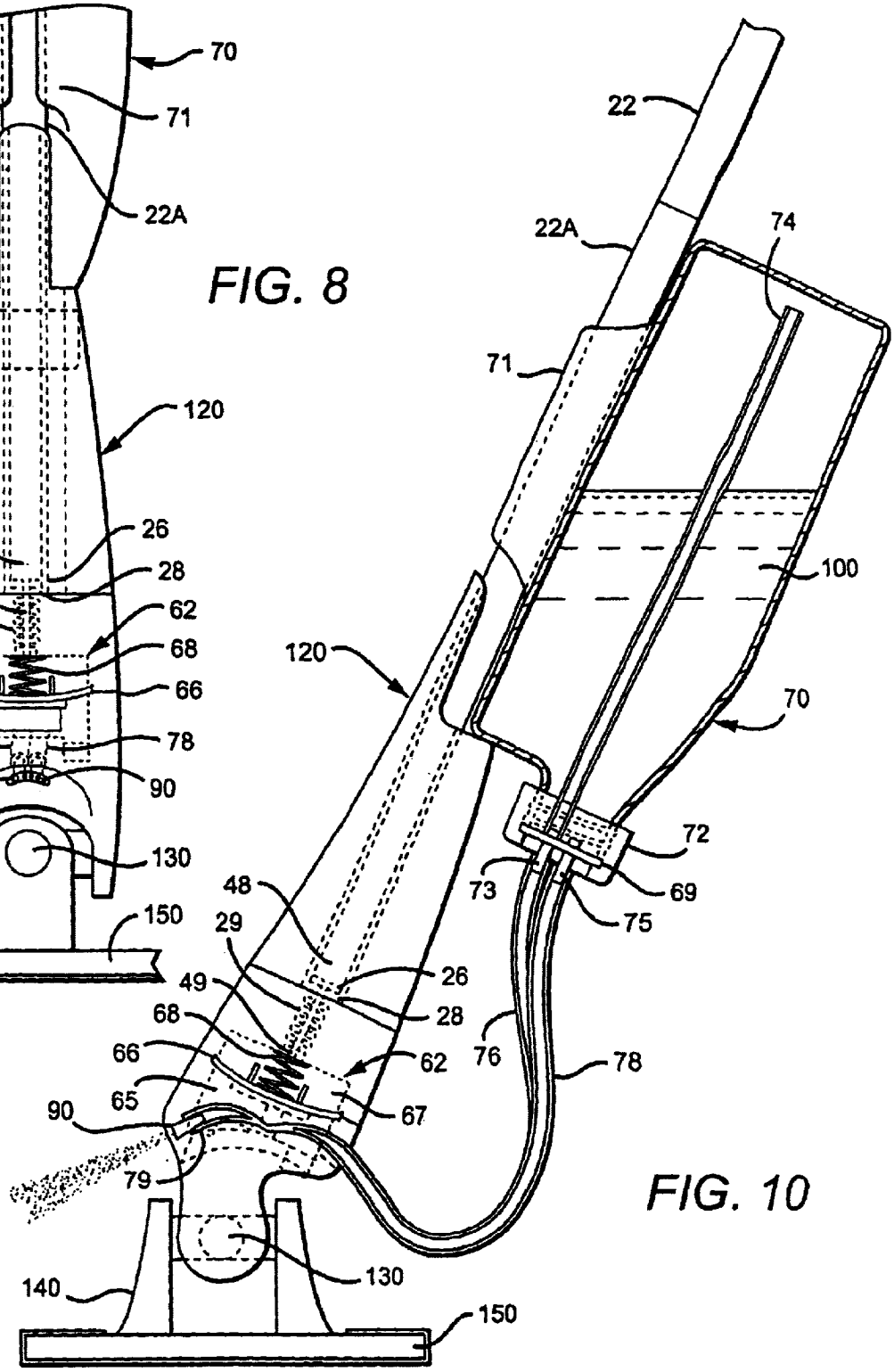
FIG. 10 is a side elevational cutaway view of the lower portion of the present invention mop assembly.

In operation, the valve actuation force means such as coil spring 68 exerts a positive or downward force against valve actuation seam 66 which in turn exerts a positive downward force on valve shutoff means 56 and 58 which therefore close off lines 76 and 78. In addition to a separate positive force means such as the coil spring or compression sponge, the positive force means can also be generated by a more rigid flexible seam 66 which exerts a normally downward force to press against and close the valves. When the grip member is actuated by being pulled upwardly on the handle to increase the volume in chamber 46 to thereby create a negative suction force in air passage 48, the negative suction force is exerted against valve actuation seam 66 which force is sufficient to overcome the positive downward force of coil spring 68 to move the valve actuation seam 66 away from the valve shutoff means 56 and 58 which pinch valves release lines 76 and 78. With line 78 opened, cleaning fluid 100 can flow from fluid reservoir 70 through fluid discharge line 78 and into spray nozzle 90 so that cleaning fluid 100 is discharged from the nozzle 90 and is sprayed in front of the mop, as illustrated in FIGS. 7, 8 and 10. At the same time, atmospheric air is permitted to enter air supply line 76 and travel along air supply line 76 into air supply rod 74 and into fluid reservoir 70 so that as cleaning fluid 100 exits the fluid supply reservoir 70, an equal volume of air enters the fluid supply reservoir, to thereby assure a smooth discharge of cleaning fluid 100. If the reservoir is made of flexible collapsible material, the air supply can be eliminated.

The lower portion of the mop 10 is surrounded by a housing 120 which surrounds and protects the lower portion of the handle and the entire actuation diaphragm assembly 62. The spray nozzle 90 extends out of an opening 122 in housing 120. The lower portion of the housing 120 terminates in attachment members 124 and 126 which are rotatably attached to a universal joint 130 which in turn is attached to the mop support bracket 140 which removably retains a cleaning implement such as disposable pad 150. The location of the spray nozzle opening 122 is positioned above and remote from the universal joint 130 so that when cleaning liquid 100 is discharged from the nozzle, the cleaning liquid will spray ahead of the cleaning implement 150 for an effective discharge which facilitates ease of cleaning as the mop can be pushed forwardly over the discharged cleaning liquid 100.

To reverse the process, the grip member 30 is pushed downwardly on handle 20 so that the fixed piston 42 and opening 40 are moved closer to top plug 36 so that the volume of air in chamber 46 is reduced, thereby forcing air back into air passage 48 through opening 40 so that the negative suction force within air passage 48 is eliminated and the air is returned to atmospheric pressure. As a result, the positive downward force of coil spring 68 becomes the dominant internal force and pushes against valve actuation seam 66 which in turn pushes against valve shutoff means 56 and 58 which thereby close off the flow of fluid in supply lines 76 and 78 so that air no longer can flow from the atmosphere into supply line 76 and cleaning fluid 100 no longer can flow out line 78 into discharge nozzle 90.

Therefore, the use of the pump action generated by the grip means 30 generating a suction force within the air passage in the handle to overcome the valve closing spring force enables a smooth discharge of cleaning fluid out of the spray nozzle 90 without requiring an expensive trigger mechanism or motor to facilitate a smooth discharge of cleaning fluid. The pump action is a simple and inexpensive yet very effective mechanism which uses atmosphere and pneumatics to cause power transmission from the grip area of the mop handle to the fluid valve actuation area. The valve actuation assembly is also an inexpensive yet very efficient system which utilizes a pair of valve closings means such as a pinch valve to be in a normally closed position through a positive force generated by a coil spring and which force is overcome by the suction force generated by the pump action grip member to open the valves to permit cleaning fluid to be discharged through a spray nozzle coil and an equal volume of air to enter the fluid reservoir to facilitate a smooth discharge of fluid.

Defined in detail, the present invention is a mop having a handle with a lower end, and a cleaning implement, the mop comprising: (a) the handle having an exterior circumferential wall and an interior air passage running from a transverse opening at a location in the circumferential wall and extending to the lower end of the handle; (b) a grip tube slidably affixed to the handle and having a cylindrical interior wall, an interior top plug having an interior opening surrounding the handle and affixed to the cylindrical interior wall and a fixed piston having an interior opening surrounding the handle and affixed to the handle at a location adjacent the transverse opening in the exterior circumferential wall of the handle so that it can slidably move within the cylindrical interior wall, such that the top plug, cylindrical interior wall and fixed piston form a variable internal chamber surrounding the handle at the location of the transverse opening; (c) a fluid reservoir containing cleaning fluid therein attached to a section of the mop handle, and having a closing means to retain the cleaning fluid therein; (d) an air supply rod extending into the fluid reservoir and terminating above the level of the cleaning fluid within the reservoir and an air supply line extending from the closing means and in fluid communication with the air supply rod; (e) a fluid discharge line extending into the closing means and in fluid communication with the cleaning fluid; (f) a valve actuation diaphragm in fluid communication with the interior air passage within the handle at a location adjacent to the lower end of the handle; (g) the fluid discharge line running through the valve actuation diaphragm and a valve shutoff means within the diaphragm surrounding a portion of the fluid discharge line, the fluid discharge line terminating in a fluid nozzle positioned above the cleaning implement; (h) the air supply line running through the valve actuation diaphragm and a valve shutoff means within the diaphragm and surrounding a portion of the air supply line, the air supply line terminating in a source of atmospheric air; and (i) the valve actuation diaphragm containing a positive force means to cause both shutoff valves to be normally closed; (j) whereby, when the grip member is pushed in one direction on the handle, the volume of space in the chamber in the grip member is expanded driving air into the chamber from the transverse opening in the handle and generating a suction vacuum force in the handle interior air passage, which suction force is sufficient to overcome the shutoff valve closing positive force and cause both shutoff valves to open both lines so that cleaning fluid runs through the fluid discharge line and squirts out of the nozzle in front of the cleaning implement while an equal volume of air fills the fluid reservoir, and when the grip member is pushed in the opposite direction along the handle, the volume of the chamber within the grip member is decreased and forces air back into the handle interior passage and eliminates the suction force so that the shutoff valve closing positive force acts to close both shutoff valves.

Also defined in detail, the present invention is a mop having a handle with a lower end, and a cleaning implement, the mop comprising: (a) the handle having an exterior circumferential wall and an interior air passage running from a transverse opening at a location in the circumferential wall and extending to the lower end of the handle; (b) a grip member slidably affixed to the handle, a portion of the interior of the grip member forming an airtight chamber surrounding the handle at the location of the transverse opening, and means to enable the volume within the chamber to be increased when the grip member is moved in one direction along the handle and to enable the volume within the chamber to be decreased when the grip member is moved in the opposite direction along the handle; (c) a fluid reservoir containing cleaning fluid therein attached to a section of the mop handle, and having a closing means to retain the cleaning fluid therein; (d) an air supply rod extending into the fluid reservoir and terminating above the level of the cleaning fluid within the reservoir and an air supply line extending from the closing means and in fluid communication with the air supply rod; (e) a fluid discharge line extending into the closing means and in fluid communication with the cleaning fluid; (f) a valve actuation diaphragm in fluid communication with the interior air passage within the handle at a location adjacent to the lower end of the handle; (g) the fluid discharge line running through the valve actuation diaphragm and a valve shutoff means within the diaphragm surrounding a portion of the fluid discharge line, the fluid discharge line terminating in a fluid nozzle positioned above the cleaning implement; (h) the air supply line running through the valve actuation diaphragm and a valve shutoff means within the diaphragm and surrounding a portion of the air supply line, the air supply line terminating in a source of atmospheric air; and (i) the valve actuation diaphragm containing a positive force means to cause both shutoff valves to be normally closed; (j) whereby, when the grip member is pushed in one direction on the handle, the volume of space in the chamber in the grip member is expanded driving air into the chamber from the transverse opening in the handle and generating a suction vacuum force in the handle interior air passage, which suction force is sufficient to overcome the shutoff valve closing positive force and cause both shutoff valves to open both lines so that cleaning fluid runs through the fluid discharge line and squirts out of the nozzle in front of the cleaning implement while an equal volume of air fills the fluid reservoir, and when the grip member is pushed in the opposite direction along the handle, the volume of the chamber within the grip member is decreased and forces air back into the handle interior passage and eliminates the suction force so that the shutoff valve closing positive force acts to close both shutoff valves.

Defined broadly, the present invention is a mop having a handle with a lower end, and a cleaning implement, the mop comprising: (a) the handle having an exterior circumferential wall and an interior air passage running from a transverse opening at a location in the circumferential wall and extending to the lower end of the handle; (b) a grip tube slidably affixed to the handle and having a cylindrical interior wall, an interior top plug having an interior opening surrounding the handle and affixed to the cylindrical interior wall and a fixed piston having an interior opening surrounding the handle and affixed to the handle at a location adjacent the transverse opening in the exterior circumferential wall of the handle so that it can slidably move within the cylindrical interior wall, such that the top plug, cylindrical interior wall and fixed piston form a variable internal chamber surrounding the handle at the location of the transverse opening; (c) a fluid reservoir containing cleaning fluid therein attached to a section of the mop handle and having a closing means to retain the cleaning fluid therein; (d) a first rod means extending into the closing means and connected at one end to an air supply rod which extends into the fluid reservoir and terminates adjacent the interior top of the reservoir above the level of the cleaning fluid, and the rod's opposite end connected to an air supply line; (e) a second rod means extending into the closing means and in fluid communication with the cleaning fluid and connected at its end outside the reservoir to a fluid discharge line; and (f) a valve actuation diaphragm divided into an upper chamber and a lower chamber by a flexible valve actuation seam, the lower end of the mop handle and its interior air passage connected to the valve actuation diaphragm such that the air passage in the handle is in fluid communication with the upper chamber, the upper chamber housing a valve actuation force which exerts a downward positive force on the valve actuation seam, the lower chamber housing a first valve shutoff means connected to the air supply line and a second valve shutoff means connected to the fluid discharge line, the positive force from the valve actuation force causing the valve actuation seam to close both shutoff valves, the air supply line extending through the lower chamber and ending at a source of atmospheric air, and the fluid discharge line extending through the lower chamber and terminating in a fluid discharge nozzle; (g) whereby, when the grip tube is pushed downwardly on the handle, the volume of space in the chamber in the grip tube is expanded driving air into the chamber from the transverse opening in the handle and generating a suction vacuum force in the handle interior air passage, which suction force is sufficient to overcome the positive force of the valve actuation force to cause the valve actuation seam to be removed from the valve shutoff means to open both lines so that cleaning fluid runs through the fluid discharge line and squirts out of the nozzle in front of the cleaning implement while an equal volume of air fills the fluid reservoir, and an upward pull on the grip tube causes the volume of the chamber within the grip tube to decrease and force air back into the handle interior air passage and eliminate the suction force so that the positive force from the valve actuation force acts upon the valve actuation seam to close both shutoff valves.

Also defined broadly, the present invention is a mop having a handle with a lower end, and a cleaning implement, the mop comprising: (a) the handle having an exterior circumferential wall and an interior air passage running from a transverse opening at a location in the circumferential wall and extending to the lower end of the handle; (b) a grip member slidably affixed to the handle, a portion of the interior of the grip member forming an airtight chamber surrounding the handle at the location of the transverse opening, and means to enable the volume within the chamber to be increased when the grip member is moved in one direction along the handle and to enable the volume within the chamber to be decreased when the grip member is moved in the opposite direction along the handle; (c) a fluid reservoir containing cleaning fluid therein attached to a section of the mop handle and having a closing means to retain the cleaning fluid therein; (d) a first rod means extending into the closing means and connected at one end to an air supply rod which extends into the fluid reservoir and terminates adjacent the interior top of the reservoir above the level of the cleaning fluid, and the rod's opposite end connected to an air supply line; (e) a second rod means extending into the closing means and in fluid communication with the cleaning fluid and connected at its end outside the reservoir to a fluid discharge line; and (f) a valve actuation diaphragm divided into an upper chamber and a lower chamber by a flexible valve actuation seam, the lower end of the mop handle and its interior air passage connected to the valve actuation diaphragm such that the air passage in the handle is in fluid communication with the upper chamber, the upper chamber housing a valve actuation force which exerts a downward positive force on the valve actuation seam, the lower chamber housing a first valve shutoff means connected to the air supply line and a second valve shutoff means connected to the fluid discharge line, the positive force from the valve actuation force causing the valve actuation seam to close both shutoff valves, the air supply line extending through the lower chamber and ending at a source of atmospheric pressure, and the fluid discharge line extending through the lower chamber and terminating in a fluid discharge nozzle; (g) whereby, when the grip member is pushed in one direction on the handle, the volume of space in the chamber in the grip member is expanded driving air into the chamber from the transverse opening in the handle and generating a suction vacuum force in the handle air passage, which suction force is sufficient to overcome the positive force of the valve actuation force to cause the valve actuation seam to be removed from the valve shutoff means to open both lines so that cleaning fluid runs through the fluid discharge line and squirts out of the nozzle in front of the cleaning implement while an equal volume of air fills the fluid reservoir, and when the grip member is moved in the opposite direction, it causes the volume of the chamber within the grip member to decrease and force air back into the handle air passage and eliminate the suction force so that the positive force from the valve actuation force acts upon the valve actuation seam to close both shutoff valves.

Defined more broadly, the present invention is a mop having a handle with a lower end, and a cleaning implement, the mop comprising: (a) the handle having an exterior circumferential wall and an interior air passage running from a transverse opening at a location in the circumferential wall and extending to the lower end of the handle; (b) a grip member slidably affixed to the handle, a portion of the interior of the grip member forming an airtight chamber surrounding the handle at the location of the transverse opening, and means to enable the volume within the chamber to be increased when the grip member is moved in one direction along the handle and to enable the volume within the chamber to be decreased when the grip member is moved in the opposite direction along the handle; (c) a fluid reservoir containing cleaning fluid therein and having means to dispense fluid from the reservoir and exit through a fluid nozzle and also having means which concurrently enables an equal volume of air to replace the fluid discharged from the reservoir; and (d) a valve actuation diaphragm in fluid communication with the interior air passage within the handle, the diaphragm housing means to open and close the fluid dispensing means and the replacement air supply means, and a positive force means which causes the means to open and close the fluid dispensing means and the replacement air supply means to be normally closed; (e) whereby, when the grip member is pushed in one direction on the handle, the volume of space in the chamber in the grip member is expanded driving air into the chamber from the transverse opening in the handle and generating a suction vacuum force in the handle interior air passage, which suction force is sufficient to overcome the positive force means in the diaphragm to cause the means to open the opening and closing means and thereby permit fluid to be dispensed through the fluid dispensing means and squirt cleaning fluid out of the nozzle in front of the cleaning implement, and when the grip member is pushed in the opposite direction along the handle, the volume of the chamber within the grip member is decreased and forces air back into the handle interior air passage and eliminates the suction force so that the opening and closing means causes the fluid dispensing means to be closed and causes the air supply means to be closed.

Also defined more broadly, the present invention is a mop having a handle with a lower end, and a cleaning implement, the mop comprising: (a) the handle having an exterior circumferential wall and an interior air passage running from a transverse opening at a location in the circumferential wall and extending to the lower end of the handle; (b) a grip member slidably affixed to the handle, a portion of the interior of the grip member forming an airtight chamber surrounding the handle at the location of the transverse opening, and means to enable the volume within the chamber to be increased when the grip member is moved in one direction along the handle and to enable the volume within the chamber to be decreased when the grip member is moved in the opposite direction along the handle; (c) a fluid reservoir containing cleaning fluid therein and having means to dispense fluid from the reservoir and exit through a fluid nozzle; and (d) a valve actuation diaphragm in fluid communication with the interior air passage within the handle, the diaphragm housing means to open and close the fluid dispensing means, and a positive force means which causes the means to open and close the fluid dispensing means to be normally closed; (e) whereby, when the grip member is pushed in one direction on the handle, the volume of space in the chamber in the grip member is expanded driving air into the chamber from the transverse opening in the handle and generating a suction vacuum force in the handle interior air passage, which suction force is sufficient to overcome the positive force means in the diaphragm to cause the means to open the opening and closing means and thereby permit fluid to be dispensed through the fluid dispensing means and squirt cleaning fluid out of the nozzle in front of the cleaning implement, and when the grip member is pushed in the opposite direction along the handle, the volume of the chamber within the grip member is decreased and forces air back into the handle interior air passage and eliminates the suction force so that the opening and closing means causes the fluid dispensing means to be closed.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A mop having a handle with a lower end, and a cleaning implement, the mop comprising:

a. said handle having an exterior circumferential wall and an interior air passage running from a transverse opening at a location in the circumferential wall and extending to the lower end of the handle;

b. a grip tube slidably affixed to said handle and having a cylindrical interior wall, an interior top plug having an interior opening surrounding said handle and affixed to said cylindrical interior wall and a fixed piston having an interior opening surrounding said handle and affixed to said handle at a location adjacent said transverse opening in the exterior circumferential wall of said handle so that it can slidably move within said cylindrical interior wall, such that the top plug, cylindrical interior wall and fixed piston form a variable internal chamber surrounding the handle at the location of the transverse opening;

c. a fluid reservoir containing cleaning fluid therein attached to a section of the mop handle and having a closing means to retain the cleaning fluid therein;

d. a first rod means extending into the closing means and connected at one end to an air supply rod which extends into the fluid reservoir and terminates adjacent the interior top of the reservoir above the level of the cleaning fluid, and the rod's opposite end connected to an air supply line;

e. a second rod means extending into the closing means and in fluid communication with the cleaning fluid and connected at its end outside the reservoir to a fluid discharge line; and f. a valve actuation diaphragm divided into an upper chamber and a lower chamber by a flexible valve actuation seam, the lower end of the mop handle and its interior air passage connected to said valve actuation diaphragm such that the air passage in the handle is in fluid communication with the upper chamber, the upper chamber housing a valve actuation force which exerts a downward positive force on the valve actuation seam, the lower chamber housing a first valve shutoff means connected to said air supply line and a second valve shutoff means connected to said fluid discharge line, the positive force from the valve actuation force causing the valve actuation seam to close both shutoff valves, the air supply line extending through the lower chamber and ending at a source of atmospheric air, and the fluid discharge line extending through the lower chamber and terminating in a fluid discharge nozzle;

g. whereby, when said grip tube is pulled upwardly on said handle, the volume of space in said chamber in the grip tube is expanded driving air into the chamber from the transverse opening in the handle and generating a suction vacuum force in said handle interior air passage, which suction force is sufficient to overcome the positive force of the valve actuation force to cause the valve actuation seam to be removed from the valve shutoff means to open both lines so that cleaning fluid runs through said fluid discharge line and squirts out of said nozzle in front of said cleaning implement while an equal volume of air fills the fluid reservoir, and a downward push on said grip tube causes the volume of the chamber within the grip tube to decrease and force air back into the handle interior air passage and eliminate the suction force so that the positive force from the valve actuation force acts upon the valve actuation seam to close both shutoff valves.

2. The mop as defined in claim 1 further comprising a seal in said top plug and a seal in said fixed piston.

3. The mop as defined in claim 1 wherein said grip tube further comprises an interior bottom plug having an interior opening surrounding said handle and affixed to the end of the cylindrical wall opposite the end affixed to the interior top plug.

4. The mop as defined in claim 1 wherein said grip tube has a textured outer casing to facilitate gripping.

5. The mop as defined in claim 1 wherein said fluid reservoir is a bottle and said closing means is a cap.

6. The mop as defined in claim 1 wherein said handle member is comprised of a multiplicity of engageable sections which are interconnected so that the interior air passage runs the entire length of the interconnected sections from the opening in the transverse wall of the uppermost section to the bottom of the lowermost section.

7. The mop as defined in claim 6 wherein said fluid reservoir is connected to the lowermost handle section.

8. The mop as defined in claim 1 wherein the valve actuation force which exerts a downward positive force within the valve actuation diaphragm is a coil spring.

9. The mop as defined in claim 1 wherein said first valve shutoff means is a pinch valve and said second valve shutoff means is a pinch valve.

10. The mop as defined in claim 1 further comprising a housing which surrounds and protects the lower portion of the handle and the entire actuation diaphragm assembly.

11. The mop as defined in claim 10 wherein said spray nozzle extends out of an opening within said housing.

12. The mop as defined in claim 10 wherein the lower portion of the housing terminates in attachment members which are rotatably attached to a universal joint which in turn is attached to a mop support bracket which retains said cleaning implement.

13. A mop having a handle with a lower end, and a cleaning implement, the mop comprising:

a. said handle having an exterior circumferential wall and an interior air passage running from a transverse opening at a location in the circumferential wall and extending to the lower end of the handle;

b. a grip tube slidably affixed to said handle and having a cylindrical interior wall, an interior top plug having an interior opening surrounding said handle and affixed to said cylindrical interior wall and a fixed piston having an interior opening surrounding said handle and affixed to said handle at a location adjacent said transverse opening in the exterior circumferential wall of said handle so that it can slidably move within said cylindrical interior wall, such that the top plug, cylindrical interior wall and fixed piston form a variable internal chamber surrounding the handle at the location of the transverse opening;

c. a fluid reservoir containing cleaning fluid therein attached to a section of the mop handle, and having a closing means to retain the cleaning fluid therein;

d. an air supply rod extending into the fluid reservoir and terminating above the level of the cleaning fluid within the reservoir and an air supply line extending from the closing means and in fluid communication with the air supply rod;

e. a fluid discharge line extending into the closing means and in fluid communication with the cleaning fluid;

f. a valve actuation diaphragm in fluid communication with the interior air passage within the handle at a location adjacent to the lower end of the handle;

g. the fluid discharge line running through the valve actuation diaphragm and a valve shutoff means within the diaphragm surrounding a portion of the fluid discharge line, the fluid discharge line terminating in a fluid nozzle positioned above the cleaning implement;

h. the air supply line running through the valve actuation diaphragm and a valve shutoff means within the diaphragm and surrounding a portion of the air supply line, the air supply line terminating in a source of atmospheric air; and i. the valve actuation diaphragm containing a positive force means to cause both shutoff valves to be normally closed;

j. whereby, when said grip member is pushed in one direction on said handle, the volume of space in said chamber in the grip member is expanded driving air into the chamber from the transverse opening in the handle and generating a suction vacuum force in said handle interior air passage, which suction force is sufficient to overcome the shutoff valve closing positive force and cause both shutoff valves to open both lines so that cleaning fluid runs through said fluid discharge line and squirts out of said nozzle in front of the cleaning implement while an equal volume of air fills the fluid reservoir, and when said grip member is pushed in the opposite direction along the handle, the volume of the chamber within the grip member is decreased and forces air back into the handle interior passage and eliminates the suction force so that the shutoff valve closing positive force acts to close both shutoff valves.

14. The mop as defined in claim 13 further comprising a seal in said top plug and a seal in said fixed piston.

15. The mop as defined in claim 13 wherein said grip tube further comprises an interior bottom plug having an interior opening surrounding said handle and affixed to the end of the cylindrical wall opposite the end affixed to the interior top plug.

16. The mop as defined in claim 13 wherein said grip tube has a textured outer casing to facilitate gripping.

17. The mop as defined in claim 13 wherein said fluid reservoir is a bottle and said closing means is a cap.

18. The mop as defined in claim 13 wherein said handle member is comprised of a multiplicity of engageable sections which are interconnected so that the interior air passage runs the entire length of the interconnected sections from the opening in the transverse wall of the uppermost section to the bottom of the lowermost section.

19. The mop as defined in claim 18 wherein said fluid reservoir is connected to the lowermost handle section.

20. The mop as defined in claim 13 wherein the positive force means is a coil spring.

21. The mop as defined in claim 13 wherein each valve shutoff means is a pinch valve.

22. The mop as defined in claim 13 further comprising a housing which surrounds and protects the lower portion of the handle and the entire actuation diaphragm assembly.

23. The mop as defined in claim 22 wherein said spray nozzle extends out of an opening within said housing.

24. The mop as defined in claim 22 wherein the lower portion of the housing terminates in attachment members which are rotatably attached to a universal joint which in turn is attached to a support bracket which retains said cleaning implement.

25. A mop having a handle with a lower end, and a cleaning implement, the mop comprising:

a. said handle having an exterior circumferential wall and an interior air passage running from a transverse opening at a location in the circumferential wall and extending to the lower end of the handle;

b. a grip member slidably affixed to said handle, a portion of the interior of the grip member forming an airtight chamber surrounding the handle at the location of the transverse opening, and means to enable the volume within the chamber to be increased when the grip member is moved in one direction along the handle and to enable the volume within the chamber to be decreased when the grip member is moved in the opposite direction along the handle;

c. a fluid reservoir containing cleaning fluid therein attached to a section of the mop handle and having a closing means to retain the cleaning fluid therein;

d. a first rod means extending into the closing means and connected at one end to an air supply rod which extends into the fluid reservoir and terminates adjacent the interior top of the reservoir above the level of the cleaning fluid, and the rod's opposite end connected to an air supply line;

e. a second rod means extending into the closing means and in fluid communication with the cleaning fluid and connected at its end outside the reservoir to a fluid discharge line; and f. a valve actuation diaphragm divided into an upper chamber and a lower chamber by a flexible valve actuation seam, the lower end of the mop handle and its interior air passage connected to said valve actuation diaphragm such that the air passage in the handle is in fluid communication with the upper chamber, the upper chamber housing a valve actuation force which exerts a downward positive force on the valve actuation seam, the lower chamber housing a first valve shutoff means connected to said air supply line and a second valve shutoff means connected to said fluid discharge line, the positive force from the valve actuation force causing the valve actuation seam to close both shutoff valves, the air supply line extending through the lower chamber and ending at a source of atmospheric pressure, and the fluid discharge line extending through the lower chamber and terminating in a fluid discharge nozzle;

g. whereby, when said grip member is pushed in one direction on said handle, the volume of space in said chamber in the grip member is expanded driving air into the chamber from the transverse opening in the handle and generating a suction vacuum force in said handle air passage, which suction force is sufficient to overcome the positive force of the valve actuation force to cause the valve actuation seam to be removed from the valve shutoff means to open both lines so that cleaning fluid runs through said fluid discharge line and squirts out of said nozzle in front of the cleaning implement while an equal volume of air fills the fluid reservoir, and when said grip member is moved in the opposite direction, it causes the volume of the chamber within the grip member to decrease and force air back into the handle air passage and eliminate the suction force so that the positive force from the valve actuation force acts upon the valve actuation seam to close both shutoff valves.

26. The mop as defined in claim 25 wherein said grip member has a textured outer casing to facilitate gripping.

27. The mop as defined in claim 25 wherein said fluid reservoir is a bottle and said closing means is a cap.

28. The mop as defined in claim 25 wherein said handle member is comprised of a multiplicity of engageable sections which are interconnected so that the interior air passage runs the entire length of the interconnected sections from the opening in the transverse wall of the uppermost section to the bottom of the lowermost section.

29. The mop as defined in claim 28 wherein said fluid reservoir is connected to the lowermost handle section.

30. The mop as defined in claim 25 wherein the valve actuation force which exerts a downward positive force within the valve actuation diaphragm is a coil spring.

31. The mop as defined in claim 25 wherein said first valve shutoff means is a pinch valve and said second valve shutoff means is a pinch valve.

32. The mop as defined in claim 25 further comprising a housing which surrounds and protects the lower portion of the handle and the entire actuation diaphragm assembly.

33. The mop as defined in claim 32 wherein said spray nozzle extends out of an opening within said housing.

34. The mop as defined in claim 32 wherein the lower portion of the housing terminates in attachment members which are rotatably attached to a universal joint which in turn is attached to a support bracket which retains said cleaning implement.

35. A mop having a handle with a lower end, and a cleaning implement, the mop comprising:

a. said handle having an exterior circumferential wall and an interior air passage running from a transverse opening at a location in the circumferential wall and extending to the lower end of the handle;

b. a grip member slidably affixed to said handle, a portion of the interior of the grip member forming an airtight chamber surrounding the handle at the location of the transverse opening, and means to enable the volume within the chamber to be increased when the grip member is moved in one direction along the handle and to enable the volume within the chamber to be decreased when the grip member is moved in the opposite direction along the handle;

c. a fluid reservoir containing cleaning fluid therein attached to a section of the mop handle, and having a closing means to retain the cleaning fluid therein;

d. an air supply rod extending into the fluid reservoir and terminating above the level of the cleaning fluid within the reservoir and an air supply line extending from the closing means and in fluid communication with the air supply rod;

e. a fluid discharge line extending into the closing means and in fluid communication with the cleaning fluid;

f. a valve actuation diaphragm in fluid communication with the interior air passage within the handle at a location adjacent to the lower end of the handle;

g. the fluid discharge line running through the valve actuation diaphragm and a valve shutoff means within the diaphragm surrounding a portion of the fluid discharge line, the fluid discharge line terminating in a fluid nozzle positioned above the cleaning implement;

h. the air supply line running through the valve actuation diaphragm and a valve shutoff means within the diaphragm and surrounding a portion of the air supply line, the air supply line terminating in a source of atmospheric air; and i. the valve actuation diaphragm containing a positive force means to cause both shutoff valves to be normally closed;

j. whereby, when said grip member is pushed in one direction on said handle, the volume of space in said chamber in the grip member is expanded driving air into the chamber from the transverse opening in the handle and generating a suction vacuum force in said handle interior air passage, which suction force is sufficient to overcome the shutoff valve closing positive force and cause both shutoff valves to open both lines so that cleaning fluid runs through said fluid discharge line and squirts out of said nozzle in front of the cleaning implement while an equal volume of air fills the fluid reservoir, and when said grip member is pushed in the opposite direction along the handle, the volume of the chamber within the grip member is decreased and forces air back into the handle interior passage and eliminates the suction force so that the shutoff valve closing positive force acts to close both shutoff valves.

36. The mop as defined in claim 35 wherein said grip member has a textured outer casing to facilitate gripping.

37. The mop as defined in claim 35 wherein said fluid reservoir is a bottle and said closing means is a cap.

38. The mop as defined in claim 35 wherein said handle member is comprised of a multiplicity of engageable sections which are interconnected so that the interior air passage runs the entire length of the interconnected sections from the opening in the transverse wall of the uppermost section to the bottom of the lowermost section.

39. The mop as defined in claim 38 wherein said fluid reservoir is connected to the lowermost handle section.

40. The mop as defined in claim 35 wherein the positive force means to cause both shutoff valves to be normally shut is a coil spring.

41. The mop as defined in claim 35 wherein each valve shutoff means is a pinch valve.

42. The mop as defined in claim 35 further comprising a housing which surrounds and protects the lower portion of the handle and the entire actuation diaphragm assembly.

43. The mop as defined in claim 42 wherein said spray nozzle extends out of an opening within said housing.

44. The mop as defined in claim 42 wherein the lower portion of the housing terminates in attachment members which are rotatably attached to a universal joint which in turn is attached to a mop support bracket which retains said cleaning implement.

45. A mop having a handle with a lower end, and a cleaning implement, the mop comprising:

a. said handle having an exterior circumferential wall and an interior air passage running from a transverse opening at a location in the circumferential wall and extending to the lower end of the handle;

b. a grip member slidably affixed to said handle, a portion of the interior of the grip member forming an airtight chamber surrounding the handle at the location of the transverse opening, and means to enable the volume within the chamber to be increased when the grip member is moved in one direction along the handle and to enable the volume within the chamber to be decreased when the grip member is moved in the opposite direction along the handle;

c. a fluid reservoir containing cleaning fluid therein and having means to dispense fluid from the reservoir and exit through a fluid nozzle and also having means which concurrently enables an equal volume of air to replace the fluid discharged from the reservoir; and d. a valve actuation diaphragm in fluid communication with the interior air passage within the handle, the diaphragm housing means to open and close the fluid dispensing means and the replacement air supply means, and a positive force means which causes the means to open and close the fluid dispensing means and the replacement air supply means to be normally closed;

e. whereby, when said grip member is pushed in one direction on said handle, the volume of space in said chamber in the grip member is expanded driving air into the chamber from the transverse opening in the handle and generating a suction vacuum force in said handle interior air passage, which suction force is sufficient to overcome the positive force means in the diaphragm to cause the means to open the opening and closing means and thereby permit fluid to be dispensed through the fluid dispensing means and squirt cleaning fluid out of said nozzle in front of the cleaning implement, and when said grip member is pushed in the opposite direction along the handle, the volume of the chamber within the grip member is decreased and forces air back into the handle interior air passage and eliminates the suction force so that the opening and closing means causes the fluid dispensing means to be closed and causes the air supply means to be closed.

46. The mop as defined in claim 45 wherein said grip member has a textured outer casing to facilitate gripping.

47. The mop as defined in claim 45 wherein said fluid reservoir is a bottle.

48. The mop as defined in claim 45 wherein said handle member is comprised of a multiplicity of engageable sections which are interconnected so that the interior air passage runs the entire length of the interconnected sections from the opening in the transverse wall of the uppermost section to the bottom of the lowermost section.

49. The mop as defined in claim 48 wherein.said fluid reservoir is connected to the lowermost handle section.

50. The mop as defined in claim 45 further comprising a housing which surrounds and protects the lower portion of the handle and the entire actuation diaphragm assembly.

51. The mop as defined in claim 50 wherein said spray nozzle extends out of an opening within said housing.

52. The mop as defined in claim 50 wherein the lower portion of the housing terminates in attachment members which are rotatably attached to a universal joint which in turn is attached to a mop support bracket which retains the cleaning implement.

53. A mop having a handle with a lower end, and a cleaning implement, the mop comprising:

a. said handle having an exterior circumferential wall and an interior air passage running from a transverse opening at a location in the circumferential wall and extending to the lower end of the handle;

b. a grip member slidably affixed to said handle, a portion of the interior of the grip member forming an airtight chamber surrounding the handle at the location of the transverse opening, and means to enable the volume within the chamber to be increased when the grip member is moved in one direction along the handle and to enable the volume within the chamber to be decreased when the grip member is moved in the opposite direction along the handle;

c. a fluid reservoir containing cleaning fluid therein and having means to dispense fluid from the reservoir and exit through a fluid nozzle; and d. a valve actuation diaphragm in fluid communication with the interior air passage within the handle, the diaphragm housing means to open and close the fluid dispensing means, and a positive force means which causes the means to open and close the fluid dispensing means to be normally closed;

e. whereby, when said grip member is pushed in one direction on said handle, the volume of space in said chamber in the grip member is expanded driving air into the chamber from the transverse opening in the handle and generating a suction vacuum force in said handle interior air passage, which suction force is sufficient to overcome the positive force means in the diaphragm to cause the means to open the opening and closing means and thereby permit fluid to be dispensed through the fluid dispensing means and squirt cleaning fluid out of said nozzle in front of the cleaning implement, and when said grip member is pushed in the opposite direction along the handle, the volume of the chamber within the grip member is decreased and forces air back into the handle interior air passage and eliminates the suction force so that the opening and closing means causes the fluid dispensing means to be closed.

* * * * *